US011349196B2

(12) United States Patent
Chen et al.

(10) Patent No.: US 11,349,196 B2
(45) Date of Patent: May 31, 2022

(54) ANTENNA STRUCTURE

(71) Applicant: Shenzhen Next Generation Communications Limited, Shenzhen (CN)

(72) Inventors: Jia Chen, Shenzhen (CN); Kuo-Cheng Chen, New Taipei (TW); Jian-Wei Chang, New Taipei (TW); Zhen-Chang Tang, Shenzhen (CN); Bo Peng, Shenzhen (CN); Wei-Yu Ye, Shenzhen (CN); Chun-Sheng Wu, New Taipei (TW); Yi-Ling Jiang, Shenzhen (CN)

(73) Assignee: Mobile Drive Netherlands B.V., Amsterdam (NL)

( * ) Notice: Subject to any disclaimer, the term of this patent is extended or adjusted under 35 U.S.C. 154(b) by 311 days.

(21) Appl. No.: 16/571,476

(22) Filed: Sep. 16, 2019

(65) Prior Publication Data

US 2020/0106160 A1 Apr. 2, 2020

(30) Foreign Application Priority Data

Sep. 29, 2018 (CN) ..... 201811150057.4

(51) Int. Cl.
*H01Q 1/24* (2006.01)
*H01Q 1/36* (2006.01)
(Continued)

(52) U.S. Cl.
CPC ..... *H01Q 1/243* (2013.01); *H01Q 1/36* (2013.01); *H01Q 5/10* (2015.01); *H01Q 5/328* (2015.01); *H01Q 9/0407* (2013.01); *H01Q 9/40* (2013.01)

(58) Field of Classification Search
CPC ..... H01Q 1/243; H01Q 1/36; H01Q 9/40; H01Q 5/10; H01Q 9/0407; H01Q 5/328;
(Continued)

(56) References Cited

U.S. PATENT DOCUMENTS 10,629,982 B2 4/2020 Kim et al.
2014/0347226 A1 11/2014 Iellici et al.
(Continued)

FOREIGN PATENT DOCUMENTS

CN 107453040 A 12/2017
CN 107645034 1/2018
CN 108281753 A 7/2018

OTHER PUBLICATIONS

Machine Translation of Wu CN Patent Publication CN 108281753 A (Year: 2018).*

*Primary Examiner* — Hai V Tran
*Assistant Examiner* — Michael M Bouizza
(74) *Attorney, Agent, or Firm* — ScienBiziP, P.C.

(57) ABSTRACT

An antenna structure includes a metal frame, at least one feed source, and a feed portion. The metal frame includes at least one radiating portion and at least one slot. The at least one slot is disposed in the at least one radiating portion or adjacent to the at least one radiating portion. The at least one feed source and the at least one radiating portion form a first antenna. The feed portion and the at least one slot form a second antenna. The at least one feed source supplies an electric current for the first antenna, thereby exciting a first working mode and generating a radiation signal in a first frequency band. The feed portion spans the at least one slot to supply the electric current for the second antenna, thereby exciting a second working mode and generating a radiation signal in a second frequency band.

18 Claims, 5 Drawing Sheets

(51) Int. Cl.

| | |
|---|---|
| ***H01Q 5/10*** | (2015.01) |
| ***H01Q 5/328*** | (2015.01) |
| ***H01Q 9/04*** | (2006.01) |
| ***H01Q 9/40*** | (2006.01) |

(58) Field of Classification Search
CPC ..... H01Q 21/28; H01Q 5/40; H01Q 9/42; H01Q 13/10; H01Q 1/44; H01Q 1/50; H01Q 5/28; H01Q 5/307; H01Q 5/35; H01Q 21/30; H01Q 1/242; H01Q 1/22
See application file for complete search history.

(56) References Cited

U.S. PATENT DOCUMENTS

2017/0294705 A1* 10/2017 Khripkov ..... H01Q 13/106
2017/0346164 A1* 11/2017 Kim ..... H01Q 1/48

* cited by examiner

ANTENNA STRUCTURE

FIELD

The subject matter herein generally relates to antenna structures, and more particularly to an antenna structure of a wireless communication device.

BACKGROUND

With the advancement of wireless communication technology, consumers have higher and higher requirements for the bandwidth of wireless communication products. Generally, upper and lower ends of a metal frame of a wireless communication device are used as an antenna. The metal frame is divided into several segments by setting a plurality of gaps in the metal frame for implementing antennas with different functions (for example, 4G Global Positioning System (GPS), and Wireless LAN (WLAN).

5G communication can add new communication frequency bands, but the antenna space is already very crowded. If 5G antennas are added to the antenna space, the performance of the other antennas may be affected, and a flexibility of antenna design may be reduced.

BRIEF DESCRIPTION OF THE DRAWINGS

Implementations of the present disclosure will now be described, by way of embodiments only, with reference to the attached figures.

DETAILED DESCRIPTION

Figure 1:
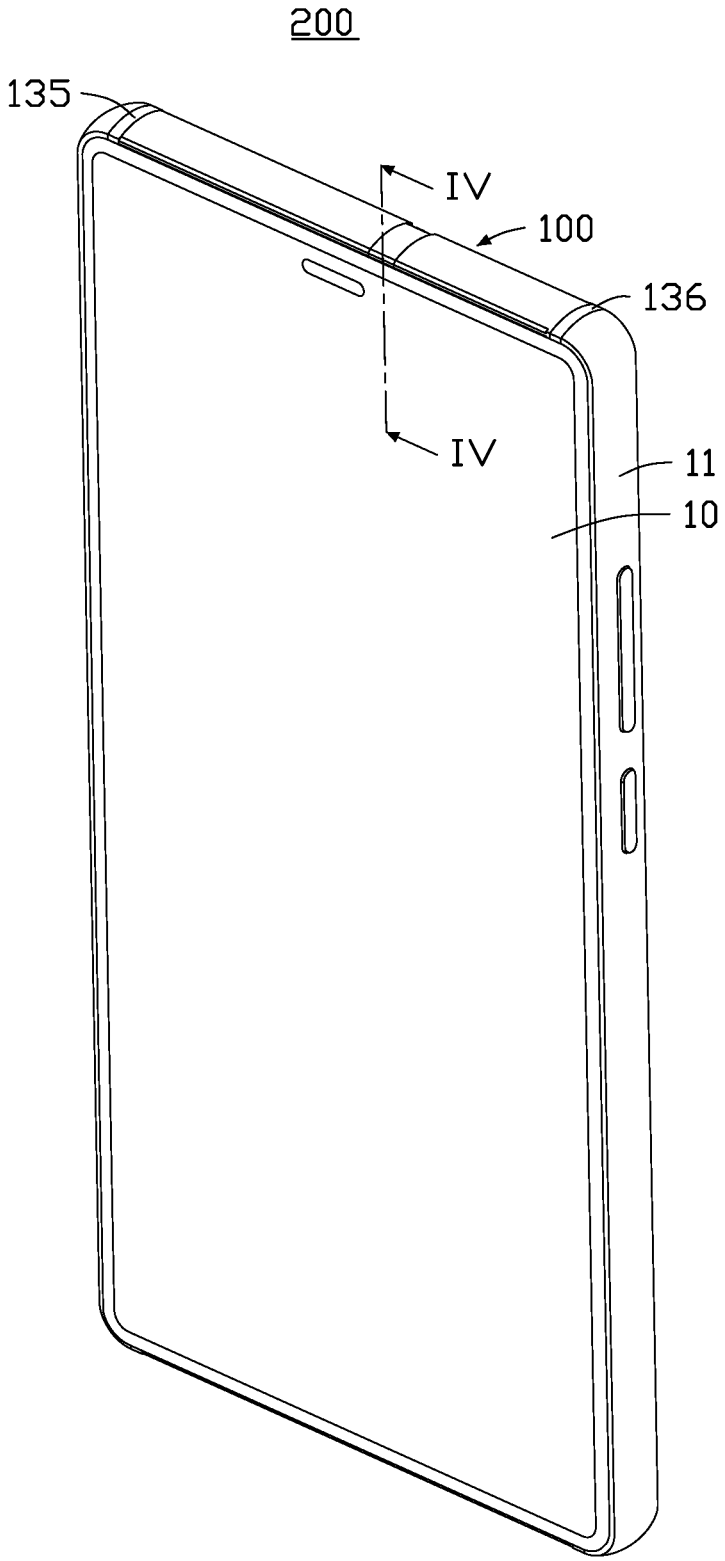
FIG. 1 is an isometric view of an embodiment of a wireless communication device.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

FIG. 1 shows an embodiment of an antenna structure 100 applicable in a mobile phone, a personal digital assistant, or other wireless communication device 200 for sending and receiving wireless signals.

Figure 2:
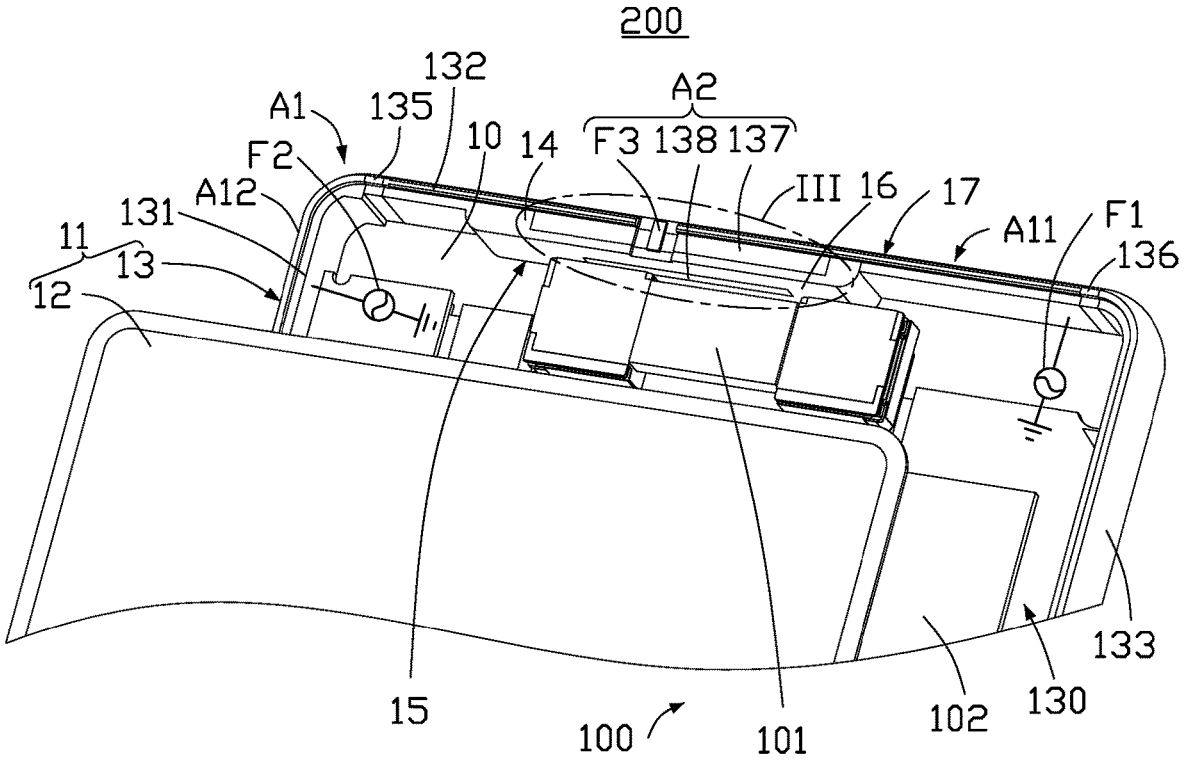
FIG. 2 is a partial exploded view of the wireless communication device in FIG. 1 including an antenna structure.

As shown in FIG. 2, the antenna structure 100 includes a housing 11 and at least one feed source. In one embodiment, the antenna structure 100 includes a first feed source F1 and a second feed source F2. The first feed source F1 and the second feed source F2 are mounted within the housing 11 and are adapted to supply an electric current.

The housing 11 may be a housing of the wireless communication device 200. The housing 11 includes at least a backplane 12 and a metal frame 13. In one embodiment, the backplane 12 is made of a non-metallic material such as plastic, glass or ceramic. The metal frame 13 is made of a metal, and the metal frame 13 may be an outer frame of the wireless communication device 200. The backplane 12 and the metal frame 13 form an outer casing of the wireless communication device 200. The wireless communication device 200 also includes a display screen 10. In one embodiment, the display screen 10 can be a touch display screen, which can be used to provide an interactive interface to implement user interaction with the wireless communication device 200. The display screen 10 is substantially parallel to the backplane 12.

The metal frame 13 is substantially an annular structure. In one embodiment, the metal frame 13 and the display screen 10 enclose an accommodating space 130. The accommodating space 130 is used for accommodating an electronic component 101, a main board 102, a processing unit, and other electronic components of the wireless communication device 200. The main board 102 can be a printed circuit board. The electronic component 101 may be a receiver module.

The metal frame 13 includes a first side portion 131, a second side portion 132, and a third side portion 133 coupled in sequence. In one embodiment, the first side portion 131 is opposite to the third side portion 133. The second side portion 132 is coupled substantially perpendicularly between the first side portion 131 and the third side portion 133. In one embodiment, the second side portion 132 is a top end of the wireless communication device 200.

The metal frame 13 includes a first gap 135, a second gap 136 and at least one slot. In one embodiment, the metal frame 13 includes a first slot 137 and a second slot 138. In one embodiment, the first gap 135 is defined in the second side portion 132 adjacent to the first side portion 131. The second gap 136 is defined in the second side portion 132 adjacent to the third side portion 133. The first slot 137 and the second slot 138 are both located in a substantially intermediate position of the second side portion 132. In other embodiments, the positions of the first gap 135, the second gap 136, the first slot 137, and the second slot 138 can be adjusted as needed.

The metal frame 13 further includes at least one radiating portion. In one embodiment, the metal frame 13 includes a first radiating portion A11 and a second radiating portion A12. The first gap 135 and the second gap 136 pass through the metal frame 13 to separate the first radiation portion A11 and the second radiation A12 from the metal frame 13. A portion of the metal frame 13 between the first gap 135 and the second gap 136 is defined as the first radiating portion A11. A portion of the second side portion 132 extending from the first gap 135 and connecting with the first side portion 131 is defined as the second radiating portion A12.

In one embodiment, the first gap 135 and the second gap 136 are filled with an insulating material, such as plastic, rubber, glass, wood, or ceramic.

In one embodiment, the first feed source F1, the second feed source F2, the first radiating portion A11, and a second radiating portion A12 form the first antenna A1. The feed portion F3, the first slot 137, and the second slot 138 form a second antenna A2. The feed portion F3 is mounted on the second side portion 132 for supplying an electric current to the second antenna A2. The feed portion F3 is perpendicular to the first slot 137 and the second slot 138. The feed portion F3 spans the first slot 137.

Figure 3:
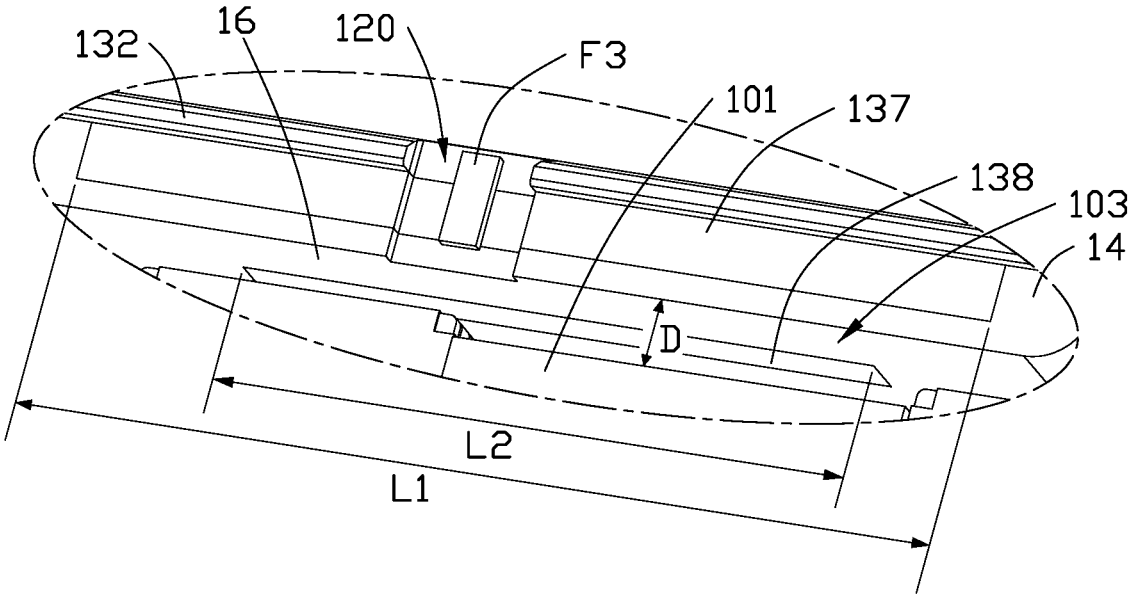
FIG. 3 is a close-up view of a circled portion III of the antenna structure in FIG. 2.

As shown in FIG. 2 and FIG. 3, the first side portion 131, the second side portion 132, and the third side portion 133 each include a first surface 14, a second surface 15 opposite to the first surface 14, and a third surface 16. The third surface 16 is located between the first surface 14 and the second surface 15. The first surface 14 is perpendicular to the third surface 16, and the second surface 15 is perpendicular to the third surface 16. The first surface 14 is parallel to and spaced from the second surface 15. In other embodiments, the third surface 16 may be coupled to the first surface 14 and the second surface 15 at different angles.

In one embodiment, the first surface 14 is adjacent to the backplane 12, and the second surface 15 is adjacent to the display screen 10. The third surface 16 faces an inner side of the metal frame 13. The first surface 14 defines a recessed portion 120. The recessed portion 120 is elongated in shape.

In one embodiment, the first slot 137 passes through the first surface 14 and the second surface 15. The second slot 138 passes through the first slot 137 and the third surface 16. The feed portion F3 is received in the recessed portion 120 of the first surface 14. The feed portion F3 is mounted on the first surface 14 and spans the first slot 137. In one embodiment, the second slot 138 is spaced a distance D from the electronic component 101. A clearance area 103 is formed between the second slot 138 and the electronic component 101.

Figure 4:
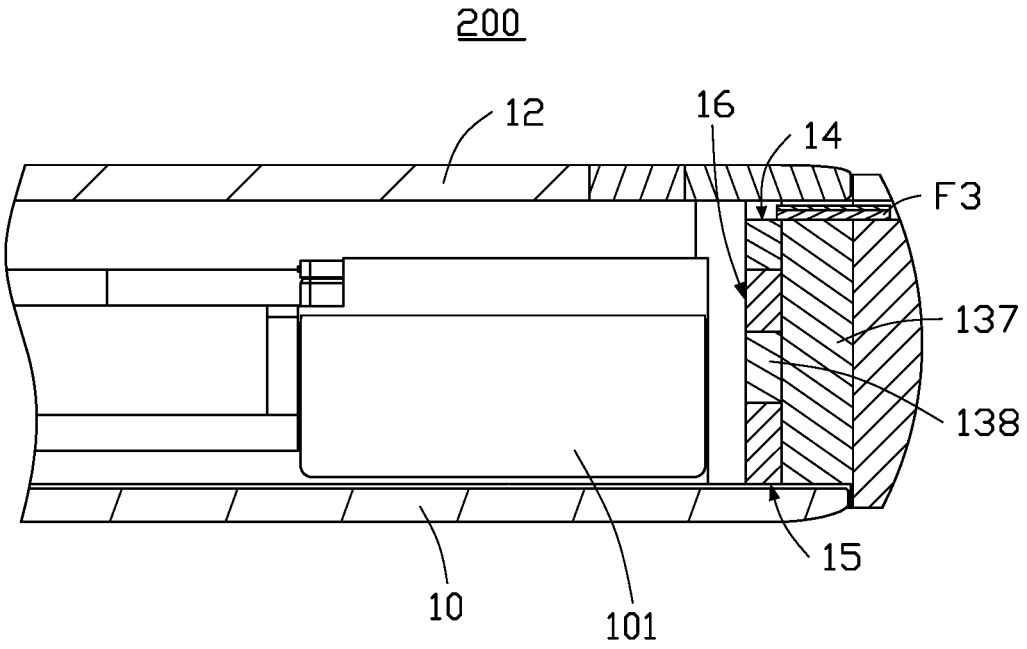
FIG. 4 is a cross-sectional view taken along line IV-IV in FIG. 1.

Referring to FIG. 4, the first slot 137 and the second slot 138 are perpendicularly coupled such that the first slot 137 and the second slot 138 have a T-shaped cross section.

In one embodiment, the first slot 137, the second slot 138, and the feed portion F3 are elongated in shape. In one embodiment, the first slot 137 and the second slot 138 may be filled with insulating material or may not be filled with insulating material. The feed portion F3 may be a wire, such as a wire of a metal segment on a flexible printed circuit board.

Referring again to FIG. 2, in one embodiment, the first slot 137 and the second slot 138 are defined in the first radiation portion A11.

In other embodiments, the first antenna A1 and the second antenna A2 are not limited to the above-described configuration and may be disposed together on the first side portion 131 or the third side portion 133. In other embodiments, the first slot 137 and the second slot 138 may be defined in the second radiating portion A12. The first slot 137 and the second slot 138 may also be defined adjacent to the first radiation portion A11 or the second radiation portion A12.

In other embodiments, the antenna structure 100 includes a slot (not labeled) for separating the first radiating portion A11 and other metal components. The slot is adjacent to the first radiating portion A11, and a length and width of the slot meets a frequency requirement of the second antenna A2. The slot may be the first slot 137 or the second slot 138.

In another embodiment, the first surface 14 is adjacent to the backplane 12, and the second surface 15 is adjacent to the display screen 10. The recessed portion 120 is defined in the backplane 12 adjacent to the first surface 14. Thus, the recessed portion 120 is not defined in the first surface 14. The feed portion F3 is mounted on the first surface 14 and received in the recessed portion of the backplane 12.

In another embodiment, the first surface 14 is adjacent to the display screen 10, and the second surface 15 is adjacent to the backplane 12. The first surface 14 defines the recessed portion 120, and the feed portion F3 is received in the recessed portion 120 of the first surface 14.

In another embodiment, the first surface 14 is adjacent to the display screen 10, and the second surface 15 is adjacent to the backplane 12. The recessed portion 120 is defined in the display screen 10 adjacent to the first surface 14. Thus, the recessed portion 120 is not defined in the first surface 14. The feed portion F3 is mounted on the first surface 14 and received in the recessed portion 120 of the display screen 10.

Referring again to FIG. 2, in one embodiment, the third surface 16 faces an inner side of the metal frame 13, and the second slot 138 passes through the first slot 137 and the third surface 16. In other embodiments, the third surface 16 is a portion of an outer surface 17 of the wireless communication device 200 and faces an outer side of the metal frame 13, so that the second slot 138 passes through the first slot 137 and the third surface 16 (the outer surface 17).

Referring again to FIG. 3, in one embodiment, a first length L1 of the first slot 137 is different from a second length L2 of the second slot 138. The first length L1 of the first slot 137 is greater than the second length L2 of the second slot 138. The first length L1 of the first slot 137 and the second length L2 of the second slot 138 are smaller than a length of the second side portion 132.

In other embodiments, the first length L1 of the first slot 137 may be smaller than the second length L2 of the second slot 138. The first length L1 of the first slot 137 and the second length L2 of the second slot 138 can be adjusted according to specific conditions.

In one embodiment, the first feed source F1 and the second feed source F2 are electrically coupled to the first antenna A1. The first feed source F1 is electrically coupled to the first radiating portion A11 to supply an electric current to the first radiating portion A11. The second feed source F2 is electrically coupled to the second radiating portion A12 to supply an electric current to the second radiating portion A12. The feed portion F3 is electrically coupled to the second antenna A2 to supply an electric current to the second antenna A2.

When the first feed source F1 and the second feed source F2 supply an electric current, the electric current flows through the first antenna A1, thereby causing the first antenna A1 to excite a first working mode and generate a radiation signal in a first frequency band.

When the feed portion F3 supplies an electric current, the electric current flows through the second antenna A2, thereby causing the second antenna A2 to excite a second working mode and generate a radiation signal in a second frequency band. When the feeding portion F3 supplies an electric current, the electric current couples to the first slot 137 and the second slot 138, thereby causing the first slot 137 and the second slot 138 respectively to excite a first resonance mode and a second resonance mode and generate radiation signals in a first resonance frequency band and a second resonance frequency band, respectively. The second working mode includes the first resonance mode and the second resonance mode, and the second frequency band includes the first resonance frequency band and the second resonance frequency band.

In one embodiment, the first working mode is at least one of a Long Term Evolution Advanced (LTE-A) low-frequency mode, an LTE-A mid-frequency mode, an LTE-A high-frequency mode, a global positioning system (GPS) mode, and a WIFI mode. The second working mode is a 5G sub-6 GHz mode. Thus, the first working mode and the second working mode are both a 5G sub-6 GHz mode. The second frequency band is higher than the first frequency band. The first frequency band may include at least one of 700-960 MHz, 1710-2170 MHz, 2300-2690 MHz, 1575, and 2400-2484 MHz. The second frequency band includes 3.3-3.6 GHz and 4.8-5.0 GHz. In one embodiment, the first working mode is 3.3-3.6 GHz, and the second working mode is 4.8-5.0 GHz.

Figure 5:
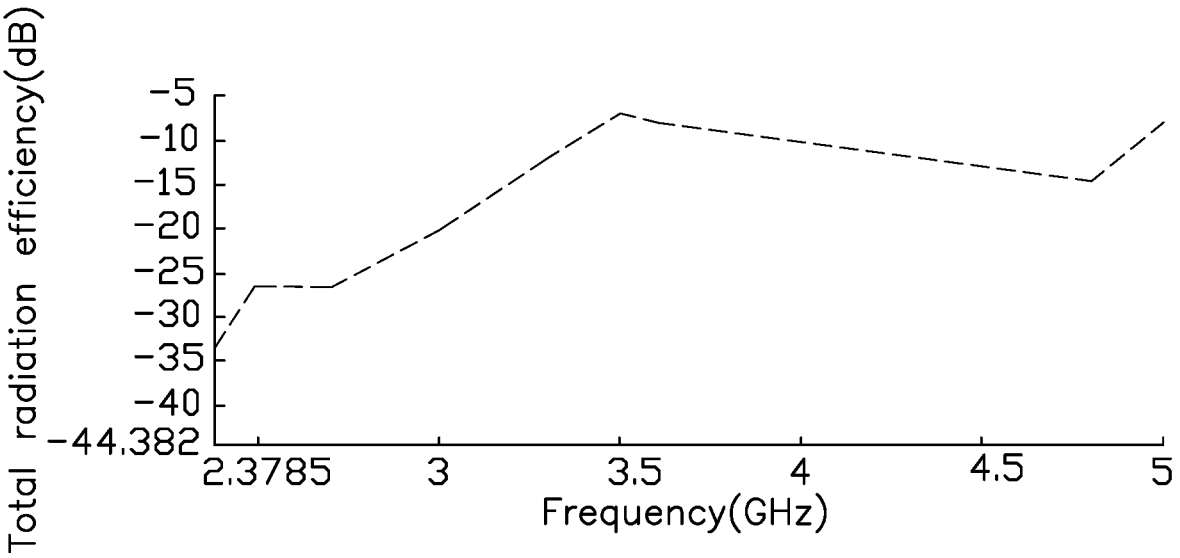
FIG. 5 is a graph of total radiation efficiency of the antenna structure.

FIG. 5 shows a graph of total radiation efficiency of the second antenna A2 in the antenna structure 100.

As described in the foregoing embodiments, the antenna structure 100 includes a metal frame 13, a first feed source F1, a second feed source F2, and a feed portion F3. A first gap 135, a second gap 136, a first slot 137, and a second slot 138 are defined in the metal frame 13. The first gap 135 and the second gap 136 separate the first radiation portion A11 and the second radiation portion A12 from the metal frame 13. The first feed source F1, the second feed source F2, the first radiating portion A11, and the second radiating portion A12 form a first antenna A1. The feed portion F3, the first slot 137, and the second slot 138 form a second antenna A2, so that the antenna structure 100 can cover the LTE-A low, mid, and high-frequency bands, the GPS band, the WIFI band, and the 5G sub-6 GHz frequency band. Thus, the wireless communication device 200 can include the 5G sub-6 GHz antenna while maintaining the original antenna performance, thereby effectively increasing the transmission bandwidth.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure applied in a wireless communication device, the antenna structure comprising:

a metal frame comprising at least one radiating portion and at least one slot;

at least one feed source; and a feed portion; wherein:

the at least one slot is disposed in the at least one radiating portion or adjacent to the at least one radiating portion;

the at least one feed source and the at least one radiating portion form a first antenna;

the feed portion and the at least one slot form a second antenna;

the at least one feed source supplies an electric current for the first antenna, thereby exciting a first working mode and generating a radiation signal in a first frequency band;

the feed portion spans the at least one slot to supply the electric current for the second antenna, thereby exciting a second working mode and generating a radiation signal in a second frequency band;

the second frequency band is higher than the first frequency band;

wherein the metal frame defines a recessed portion, and the feed portion is received in the recessed portion of the metal frame.

2. The antenna structure of claim 1, wherein: the metal frame comprises a first surface, a second surface, and a third surface; the third surface is located between the first surface and the second surface; the first surfaces is perpendicular to the third surface; the second surface is perpendicular to the third surface; the first surface is parallel to and spaced from the second surface.

3. The antenna structure of claim 2, wherein:

the at least one slot comprises a first slot and a second slot;

the first slot passes through the first surface and the second surface;

the second slot passes through the first slot and the third surface;

the feed portion is mounted on the first surface;

the feed portion spans the first slot, wherein when the feed portion supplies an electric current to the first slot and the second slot, the first slot excites a first resonance frequency mode and generates a radiation signal in a first resonance frequency band, and the second slot excites a second resonance mode and generates a radiation signal in a second resonance frequency band.

4. The antenna structure of claim 3, wherein:

the first slot is perpendicular to the second slot; and a cross-section of both the first slot and the second slot is T-shaped.

5. The antenna structure of claim 3, wherein:

the first slot, the second slot, and the feed portion are elongated in shape;

the feed portion is perpendicular to the first slot and the second slot.

6. The antenna structure of claim 2, wherein the third surface faces an inner side of the metal frame.

7. The antenna structure of claim 2, wherein:

the third surface is a portion of an outer surface of the wireless communication device; and the third surface faces an outer side of the metal frame.

8. The antenna structure of claim 1, wherein:

the at least one feed source comprises a first feed source and a second feed source;

the metal frame comprises a first gap, a second gap, a first radiating portion, and a second radiating portion;

the first gap and the second gap pass through the metal frame to separate the first radiating portion and the second radiating portion from the metal frame;

the first feed source, the second feed source, the first radiating portion, and the second radiating portion cooperatively form a first antenna;

the first feed source and the second feed source are both electrically coupled to the first antenna to supply an electric current to the first antenna, thereby causing the first antenna to excite a first working mode and generate a radiation signal in a first frequency band.

9. A wireless communication device comprising an antenna structure, the antenna structure comprising:

a metal frame comprising at least one radiating portion and at least one slot;

at least one feed source; and a feed portion; wherein:

the at least one slot is disposed in the at least one radiating portion or adjacent to the at least one radiating portion;

the at least one feed source and the at least one radiating portion form a first antenna;

the feed portion and the at least one slot form a second antenna;

the at least one feed source supplies an electric current for the first antenna, thereby exciting a first working mode and generating a radiation signal in a first frequency band;

the feed portion spans the at least one slot to supply the electric current for the second antenna, thereby exciting a second working mode and generating a radiation signal in a second frequency band;

the second frequency band is higher than the first frequency band;

wherein the wireless communication device comprises a backplane and a display screen, any one of the metal frame, the backplane, and the display screen defines a recessed portion, and the feed portion is received in the recessed portion.

10. The wireless communication device of claim 9, wherein:

the metal frame comprises a first surface, a second surface, and a third surface;

the third surface is located between the first surface and the second surface;

the first surfaces is perpendicular to the third surface;

the second surface is perpendicular to the third surface;

the first surface is parallel to and spaced from the second surface.

11. The wireless communication device of claim 10, wherein:

the at least one slot comprises a first slot and a second slot;

the first slot passes through the first surface and the second surface;

the second slot passes through the first slot and the third surface;

the feed portion is mounted on the first surface;

the feed portion spans the first slot;

wherein when the feed portion supplies an electric current to the first slot and the second slot, the first slot excites a first resonance frequency mode and generates a radiation signal in a first resonance frequency band, and the second slot excites a second resonance mode and generates a radiation signal in a second resonance frequency band.

12. The wireless communication device of claim 11, wherein:

the first slot is perpendicular to the second slot; and a cross-section of both the first slot and the second slot is T-shaped.

13. The wireless communication device of claim 11, wherein:

the first slot, the second slot, and the feed portion are elongated in shape;

the feed portion is perpendicular to the first slot and the second slot.

14. The wireless communication device of claim 10, wherein the third surface faces an inner side of the metal frame.

15. The wireless communication device of claim 10, wherein:

the third surface is a portion of an outer surface of the wireless communication device; and the third surface faces an outer side of the metal frame.

16. The wireless communication device of claim 10, wherein:

the first surface of the metal frame is adjacent to the backplane, and the second surface of the metal frame is adjacent to the display screen; and the feed portion is received in a recessed portion of either the first surface or the backplane.

17. The wireless communication device of claim 10, wherein:

the first surface of the metal frame is adjacent to the display screen, and the second surface of the metal frame is adjacent to the backplane; and the feed portion is received in a recessed portion of either the first surface or the display screen.

18. The wireless communication device of claim 9, wherein:

the at least one feed source comprises a first feed source and a second feed source;

the metal frame comprises a first gap, a second gap, a first radiating portion, and a second radiating portion;

the first gap and the second gap pass through the metal frame to separate the first radiating portion and the second radiating portion from the metal frame;

the first feed source, the second feed source, the first radiating portion, and the second radiating portion cooperatively form a first antenna;

the first feed source and the second feed source are both electrically coupled to the first antenna to supply an electric current to the first antenna, thereby causing the first antenna to excite a first working mode and generate a radiation signal in a first frequency band.

* * * * *